US009821450B2

(12) United States Patent
Schumacher

(10) Patent No.: US 9,821,450 B2
(45) Date of Patent: Nov. 21, 2017

(54) WORK SURFACE

(71) Applicant: REDesign Group, LLC, Boulder, CO (US)

(72) Inventor: Robert Schumacher, Boulder, CO (US)

(73) Assignee: REDESIGN GROUP, LLC, Boulder, CO (US)

( * ) Notice: Subject to any disclaimer, the term of this patent is extended or adjusted under 35 U.S.C. 154(b) by 22 days.

(21) Appl. No.: 15/051,307

(22) Filed: Feb. 23, 2016

(65) Prior Publication Data

US 2016/0243694 A1 Aug. 25, 2016

Related U.S. Application Data

(60) Provisional application No. 62/120,169, filed on Feb. 24, 2015.

(51) Int. Cl.

| | |
|---|---|
| ***B25B 1/02*** | (2006.01) |
| ***B25H 1/08*** | (2006.01) |
| ***B25H 1/04*** | (2006.01) |

(52) U.S. Cl.
CPC ..... *B25H 1/08* (2013.01); *B25H 1/04* (2013.01)

(58) Field of Classification Search
CPC ..... B25H 1/08; B25H 1/04
See application file for complete search history.

(56) References Cited

U.S. PATENT DOCUMENTS 4,333,638 A * 6/1982 Gillotti ..... A47B 3/087 108/36

* cited by examiner

*Primary Examiner* — Larry E Waggle, Jr.
*Assistant Examiner* — Nirvana Deonauth
(74) *Attorney, Agent, or Firm* — Sheridan Ross, PC

(57) ABSTRACT

A work surface is provided. More particularly, a work surface that is portable, and that when deployed provides a relatively stable platform is disclosed. The work surface includes a horizontal clamp track running parallel to a top surface, and one or more vertical tracks running parallel to the legs of the work surface. The horizontal track is configured to receive one or more clamps that can be used to secure a workpiece against a side of the work surface. The vertical tracks are configured to receive a support block, which can be used to support a workpiece along a side of the work surface.

19 Claims, 14 Drawing Sheets

WORK SURFACE

CROSS-REFERENCE TO RELATED APPLICATIONS

This application claims the benefit of U.S. Provisional Patent Application Ser. No. 62/120,169, filed Feb. 24, 2015, the entire disclosure of which is hereby incorporated herein by reference.

FIELD

A work surface with enhanced material holding and clamping features is provided.

BACKGROUND

The traveling carpenter, cabinetmaker/installer, and general handyperson has always needed easily transportable work surfaces for jobsite use. Traditional devices invariably involve multiple compromises between mobility, complexity, weight, versatility, and ergonomics. The skilled craftsperson requires a strong, flat, rigid, stable platform that can be set up easily, quickly, and accurately in various environments, and which allows comfortable access to workpieces of many sizes. Typical solutions to these needs involve saw horses with plywood or old doors placed on top to make a platform. These are unstable and irregular and are poor substitutes for the sort of stout work bench that would traditionally be used in a workshop, but which is too heavy and cumbersome to transport.

Numerous attempts have been made during the last 100 years to devise a good, mobile substitute for the shop bench. To varying extents, all are defined by compromise, whether in pursuit of light weight, convenient size based on transportability, and/or the complexity/variety of integrated features and accessories. Common complaints are that, for example, what is available is too small to be of practical use, too low, too flexible, or too constrained by an ill-conceived method of work to allow the craftsperson to fully utilize his/her creativity in an efficient way.

SUMMARY

Embodiments of the present disclosure provide a system including a work surface or workbench assembly for supporting workpieces. More particularly, a portable work surface or workbench that is stable, and that can be configured to hold workpieces that are large relative to the work surface is provided.

In accordance with the least to some embodiments of the present disclosure, the work surface includes a planar top surface, and a plurality of legs that are folded against a back of the planar top surface when the workbench is in a folded configuration, and that extend such that they are substantially orthogonal to the planar top surface when the work surface is in a deployed configuration.

In accordance with still other embodiments of the present disclosure, tracks or track members that are adapted to receive clamps or support blocks are provided. One or more of the tracks can be arranged such that they extend in a vertical direction, for example along the legs of the workbench. In addition, one or more of the tracks can be arranged such that they extend in a horizontal direction, for example along an edge of the top surface of the workbench. In accordance with at least some embodiments of the present disclosure, a support block can be placed at a desired location along a vertical track, to support an edge of a work piece, while a clamp can be placed at a desired location along a horizontal track, to clamp the work piece against the side of the top surface of the workbench. In accordance with still other embodiments of the present disclosure, multiple support blocks can be used, to support a work piece at multiple locations along an edge of the work piece. Moreover, multiple clamps can be used to hold the work piece in position, while that work piece is also supported by one or more support blocks.

Additional features and advantages of embodiments of the present disclosure will become more readily apparent from the following description, particularly when taken together with the accompanying drawings.

DETAILED DESCRIPTION

Figure 1:
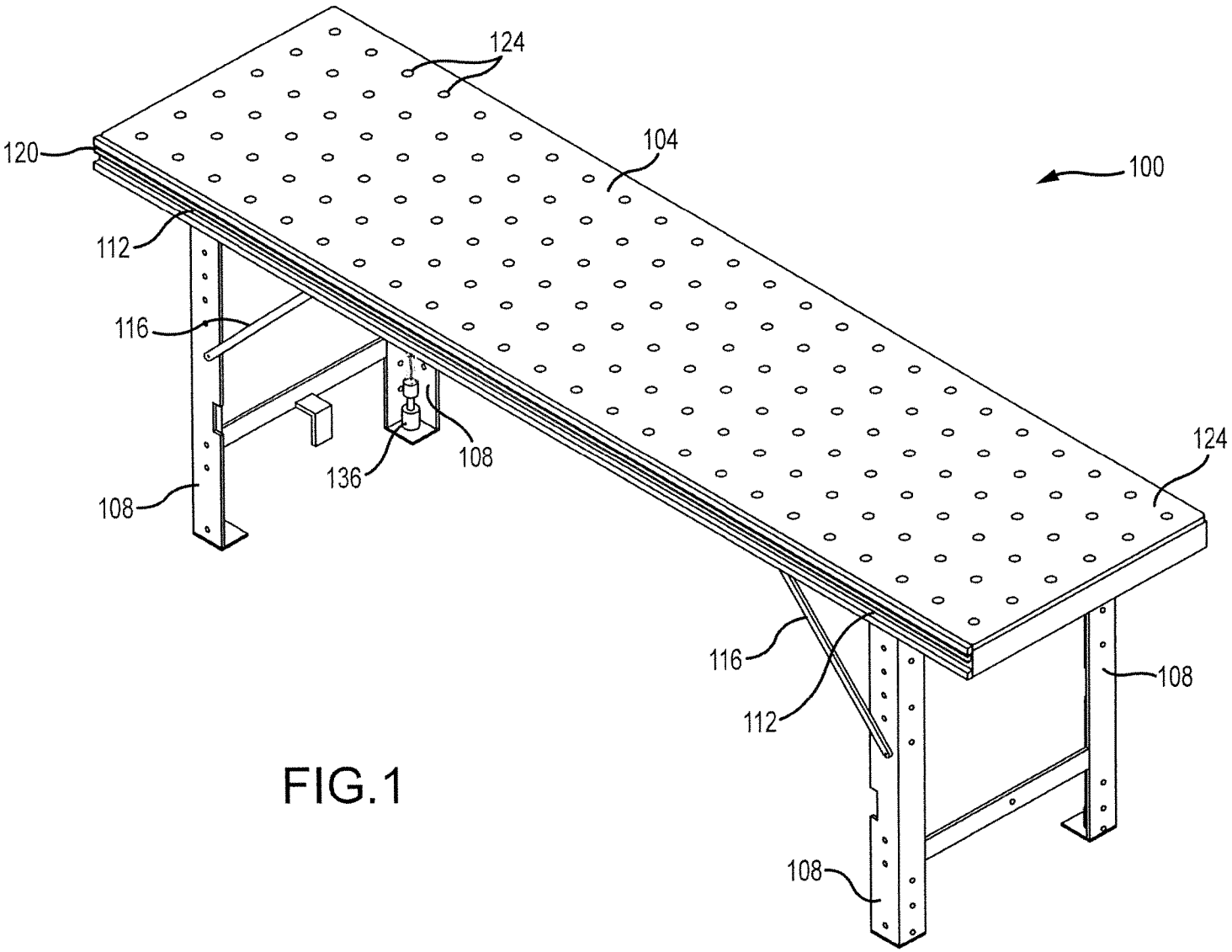
FIG. 1 is a top perspective view of a workbench in accordance with embodiments of the present disclosure, in a deployed configuration.

With reference now to FIG. 1, embodiments of the present disclosure provide a work surface or workbench 100. In accordance with at least some embodiments, the work surface 100 includes a portable work surface that can be configured in a relatively compact state for portability, and a stable, extended state for use. The work surface 100 generally includes a top surface 104, and a plurality of legs 108 that are connected to the top surface 104 by hinges or pivots 112. When configured for portability, the legs 108 are folded or stowed, such that the longitudinal axis of each leg is generally parallel to a plane corresponding to a top of the top surface 104. In a deployed state, the legs 108 are generally orthogonal to the plane of the top surface 104. The legs 108 can be held in the deployed position by braces 116. The braces 116 can be connected to the top surface 104 via a track that allows the braces to be moved with the legs, such that the braces 116 are generally parallel to the top surface 104 and the legs 108 when the legs are stowed, and such that the braces are at an angle (e.g. a 45° angle) to the top surface 104 and the legs 108 when the legs 108 are extended. In the extended position, the location of the braces 116 within the horizontal track can be fixed, for example by a threaded fastener.

The work surface or table 100 is generally brought to a worksite in a folded configuration, with the legs 108 locked against a bottom of the top surface 104 by brackets and associated threaded fasteners. In order to deploy the work surface 100 for use, the threaded fasteners holding the brackets are removed, and the legs 108 are extended such that the longitudinal axes of the legs 108 are generally orthogonal to a plane of the top surface 104. As the legs 108 are pivoted on the hinges 112, the ends of the braces 116 attached to the top surface 104 at the rails slide along those rails. Once the legs 108 are fully extended, which can correspond to the braces 116 reaching an end of the horizontal rails, fasteners attaching the ends of the braces 116 to the top surface 104 can be tightened, to fix the position of the legs 108 relative to the top surface 104. After the legs 108 have been deployed, leg leveler assemblies 136 can be adjusted by turning the support leg in the threaded insert, to prevent rocking of the work surface 100 while it is in use.

A horizontal clamp track 120 can be provided along one or more edges of the top surface 104. More particularly, and as discussed in greater detail elsewhere herein, the horizontal clamp track 120 is oriented such that workpieces can be clamped against a side of the top surface 104. Accordingly, for example where a workpiece is substantially planar, the workpiece is at an angle of 90° with respect to the plane of the top surface 104 when the workpiece is held by a clamp placed in the horizontal clamp track 120. In addition, the planar top surface server 104 can feature a plurality of holes 124 that are configured to receive clamps, dogs, and/or other accessories. The holes 124 can be arranged in a two-dimensional grid or array pattern across the top surface 104.

A leg leveler assembly 136 can be provided at a bottom end of each leg 108. Each leg leveler assembly 136 can include a threaded insert that is fixed to the associated leg 108. As an example, but without limitation, the threaded insert can include a captured nut that is friction fit and/or adhered to a support block that is in turn fixed to the leg 108. The amount by which a support surface of the leg leveler assembly 136 extends beyond the bottom of the leg 108 can be adjusted by, for example, placing a wrench or other tool on the head portion, and turning the threaded insert.

Figure 2:
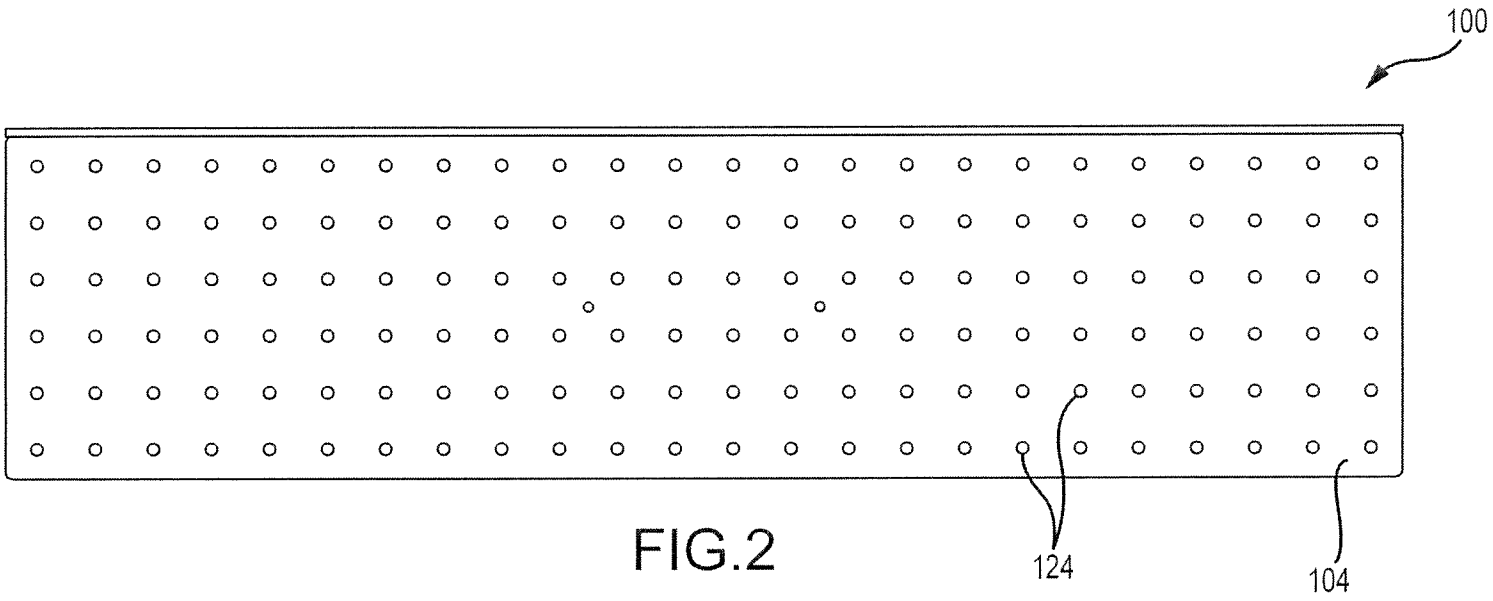
FIG. 2 is a top plan view of the workbench of FIG. 1.

FIG. 2 depicts the work surface 100, and in particular the top surface 104, in plan view. As shown, the holes or apertures 124 can be configured to form a grid of holes 124 that are regularly spaced across the top surface 104. As can be appreciated by one of skill in the art after consideration of the present disclosure, the holes 124 can receive various tools, clamps, and locating devices or accessories.

Figure 3:
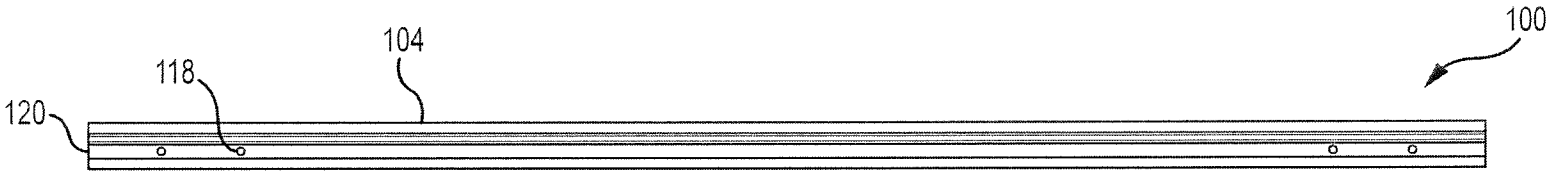
FIG. 3 is a side elevation of the workbench of FIG. 1, in a folded configuration.
Figure 4:
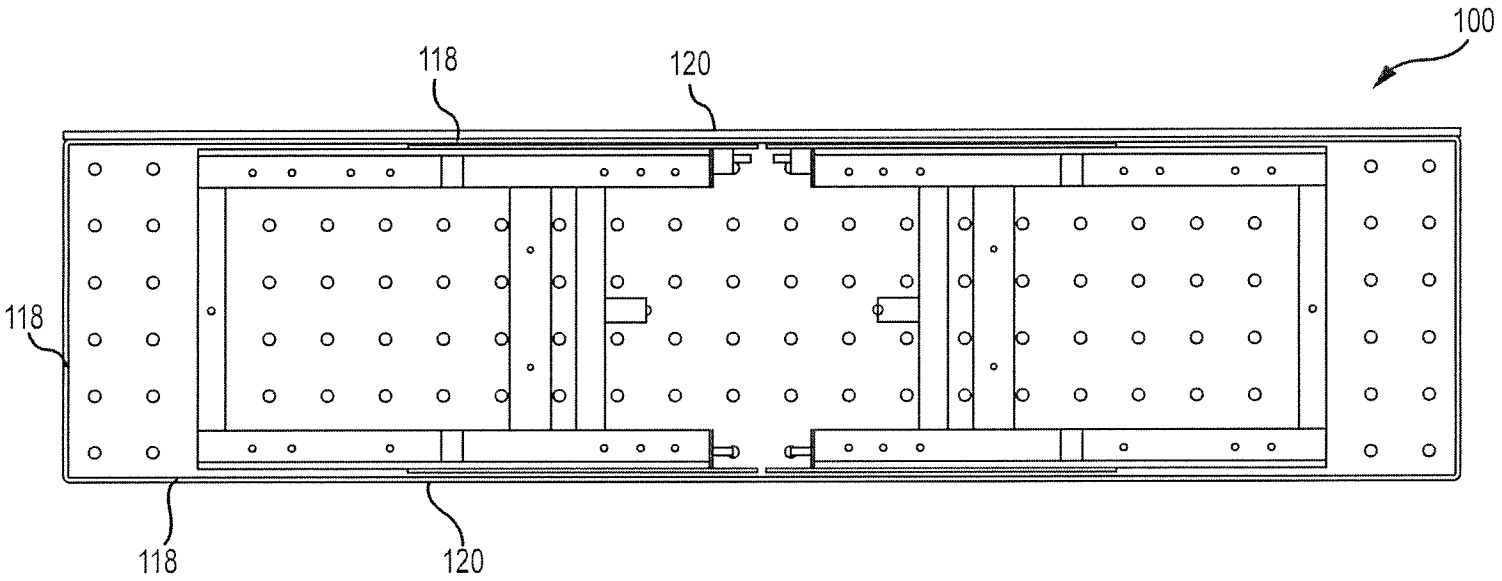
FIG. 4 is a bottom plan view of the workbench of FIG. 1, in a folded configuration.

FIG. 3 depicts the work surface 100 in elevation, and FIG. 4 depicts the work surface 100 in a bottom plan view, with the legs 108 folded parallel to the top surface 104, in a portable configuration. In this configuration, the legs 108 can be nested within sidewalls 118, for example formed by or associated with horizontal clamp tracks 120 located around a perimeter of the top surface 104.

Figure 5:
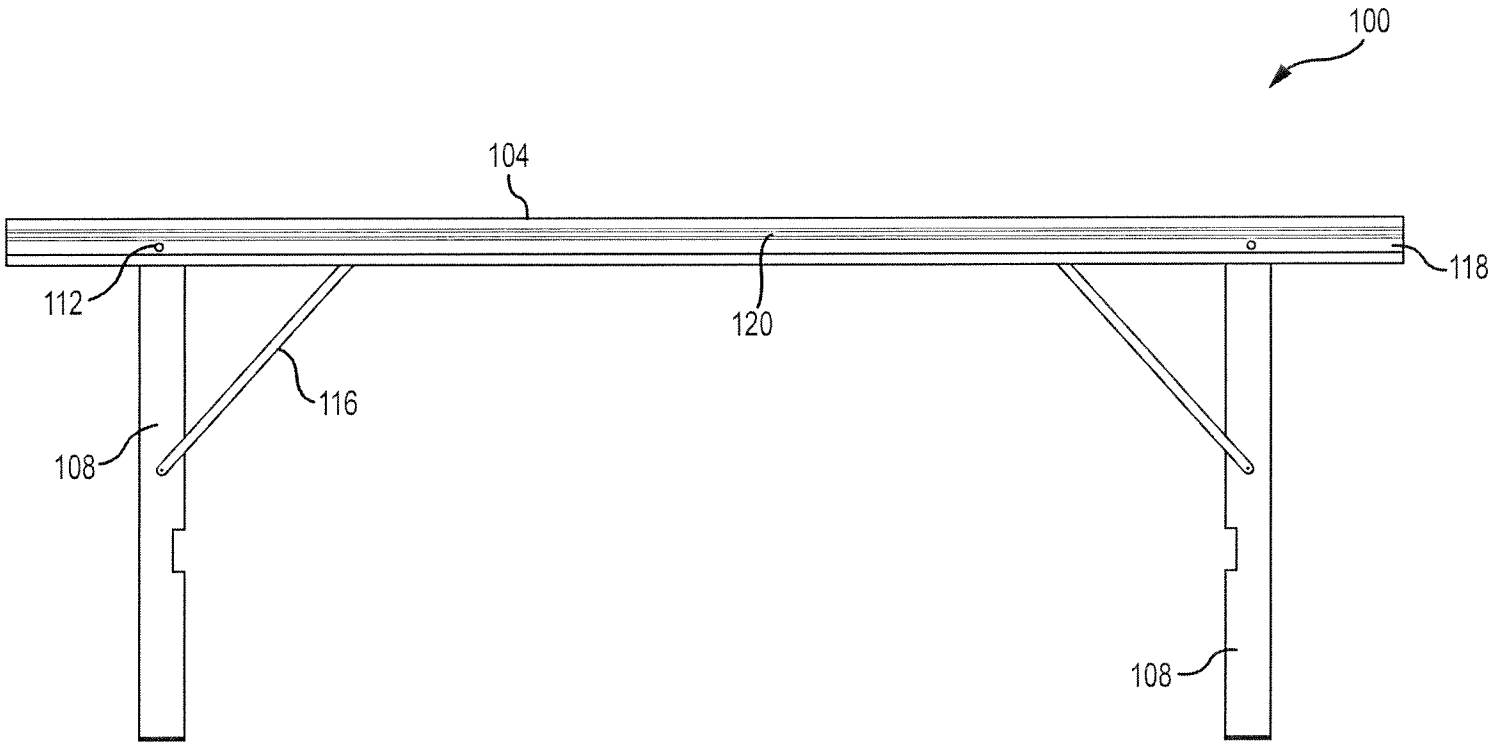
FIG. 5 is a side elevation of the workbench of FIG. 1, in a deployed configuration.
Figure 6:
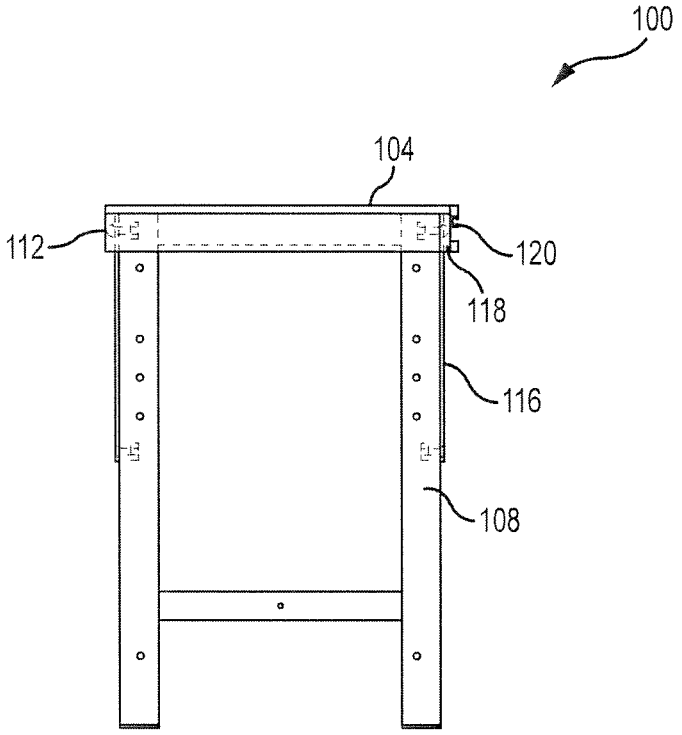
FIG. 6 is an end elevation of the workbench of FIG. 1, in a deployed configuration.

FIG. 5 depicts the work surface 108 side elevation, and FIG. 6 depicts the work surface 100 in an end elevation, in a deployed or standing configuration.

Figure 7:
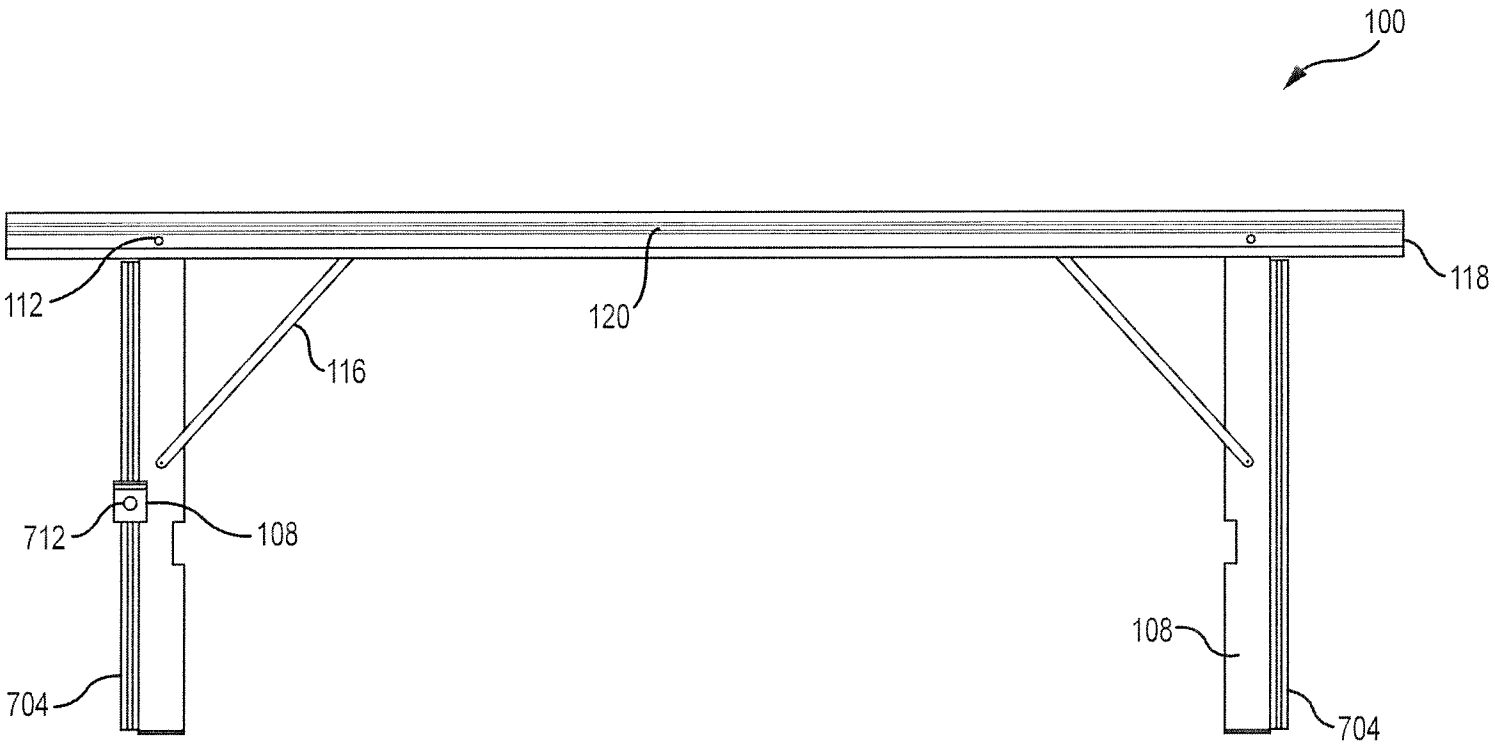
FIG. 7 is a side elevation of the workbench of FIG. 1, in a deployed configuration, and with vertical tracks installed.
Figure 8:
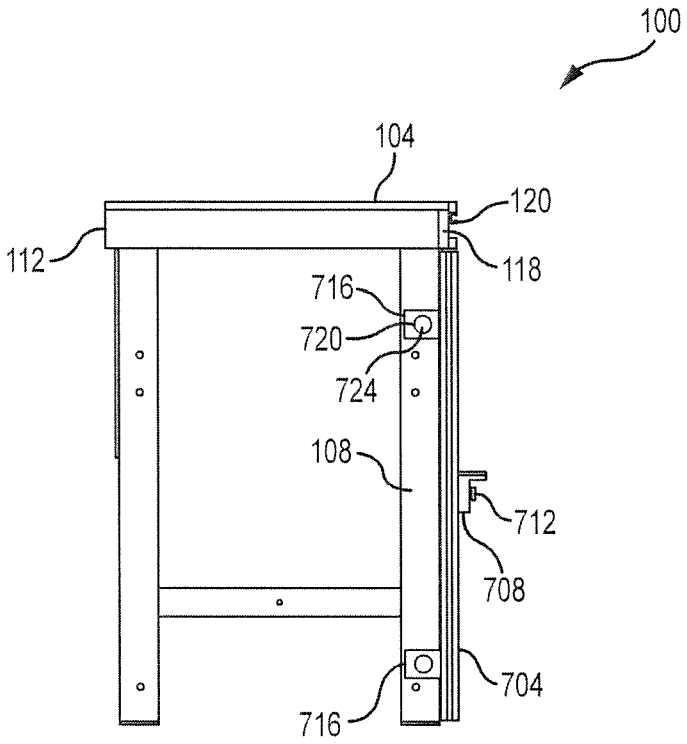
FIG. 8 is an end elevation of the workbench of FIG. 1, in a deployed configuration, and with vertical track installed.

FIG. 7 depicts the work surface 100 in a side elevation, and FIG. 8 depicts the work surface 100 in an end elevation, in a deployed or standing configuration, and with vertical tracks 704 installed. More particularly, the vertical tracks 704 are shown attached to first 108*a* and second 108*b* legs of the work surface 100. A support block 708 can be received by the vertical track 704. The position of the support block 708 along the vertical track 704 can be adjusted. More particularly, a fastening knob 712 associated with a threaded fastener can be loosened to move the support block 708 along the vertical track 704, and can be tightened to secure the support block 708 at a desired location.

With particular reference now to FIG. 8, the vertical tracks 704 can include mounting flanges or members 716. The vertical tracks 704 can be attached to an associated leg 108 by threaded fasteners 720 that pass through the mounting-flange 716 and that are associated with a knob 724. As an example the position of the vertical tracks 704 on the respective legs 108 can be determined by the threaded fasteners 720 and captured nuts on the legs 108 that receive the threaded fasteners 720, in combination with locating surfaces. In accordance with embodiments of the present disclosure, an outer surface of the vertical tracks 704 is coincident with a plane that also is coincident with an outer surface of the horizontal track 120. Although depicted in FIG. 7 as having the vertical tracks 704 on both legs 108 on a side of the work surface 100, other configurations are possible. For example, a vertical track 704 can be associated with a single leg 108, all of the legs 108, or some other number of legs 108, of the work surface 100.

Figure 9:
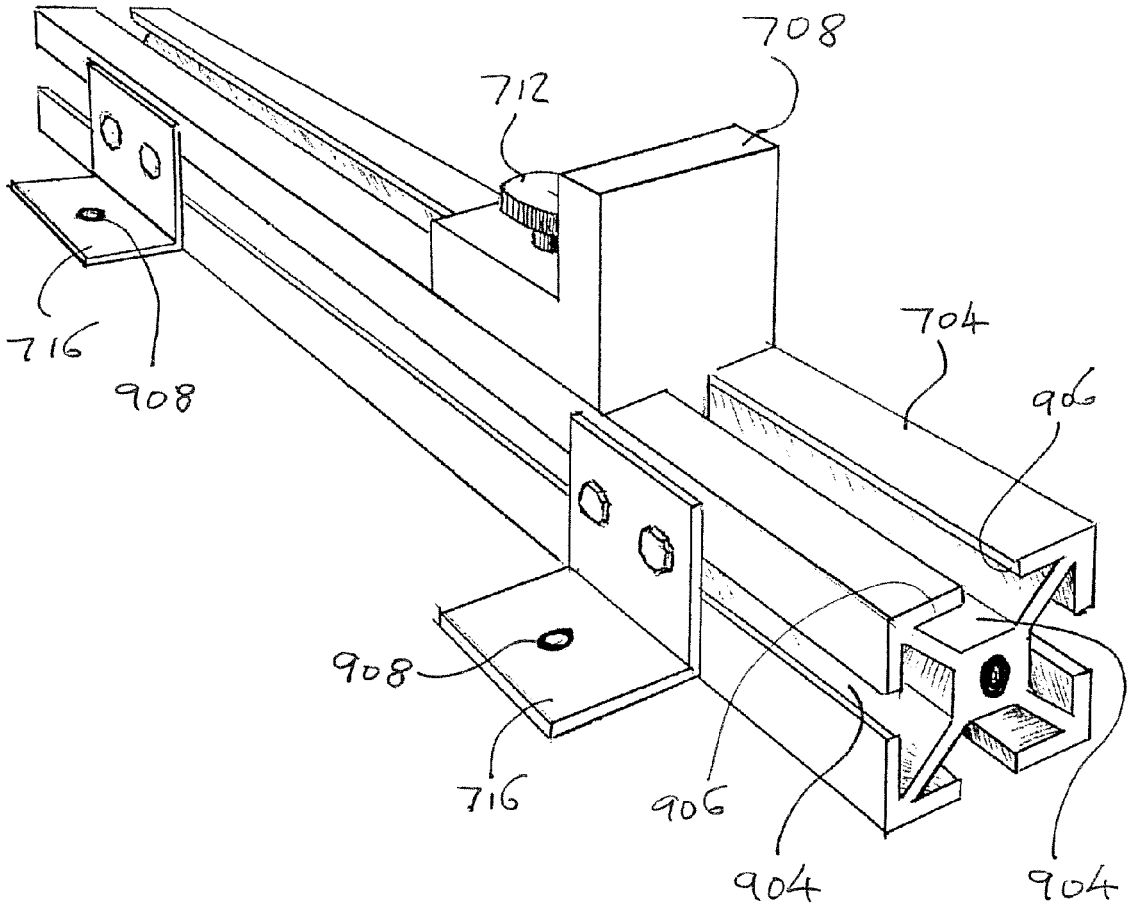
FIG. 9 is a perspective view of a vertical track and an installed support block in accordance with embodiments of the present disclosure.

With reference now to FIG. 9, a vertical track 704 is shown in a perspective view. In this example, the vertical track 704 has channels 904 and associated flanges 906 formed on each of four sides of the vertical track 704, when the vertical track 704 is viewed in cross-section. The mounting flanges 716 can include holes 908 for receiving the threaded fasteners 720, for instance as illustrated in FIG. 8. The mounting flanges 716 can be permanently or removably fixed to the vertical track 704, for example using fasteners received within one of the channels 904.

Figure 10:
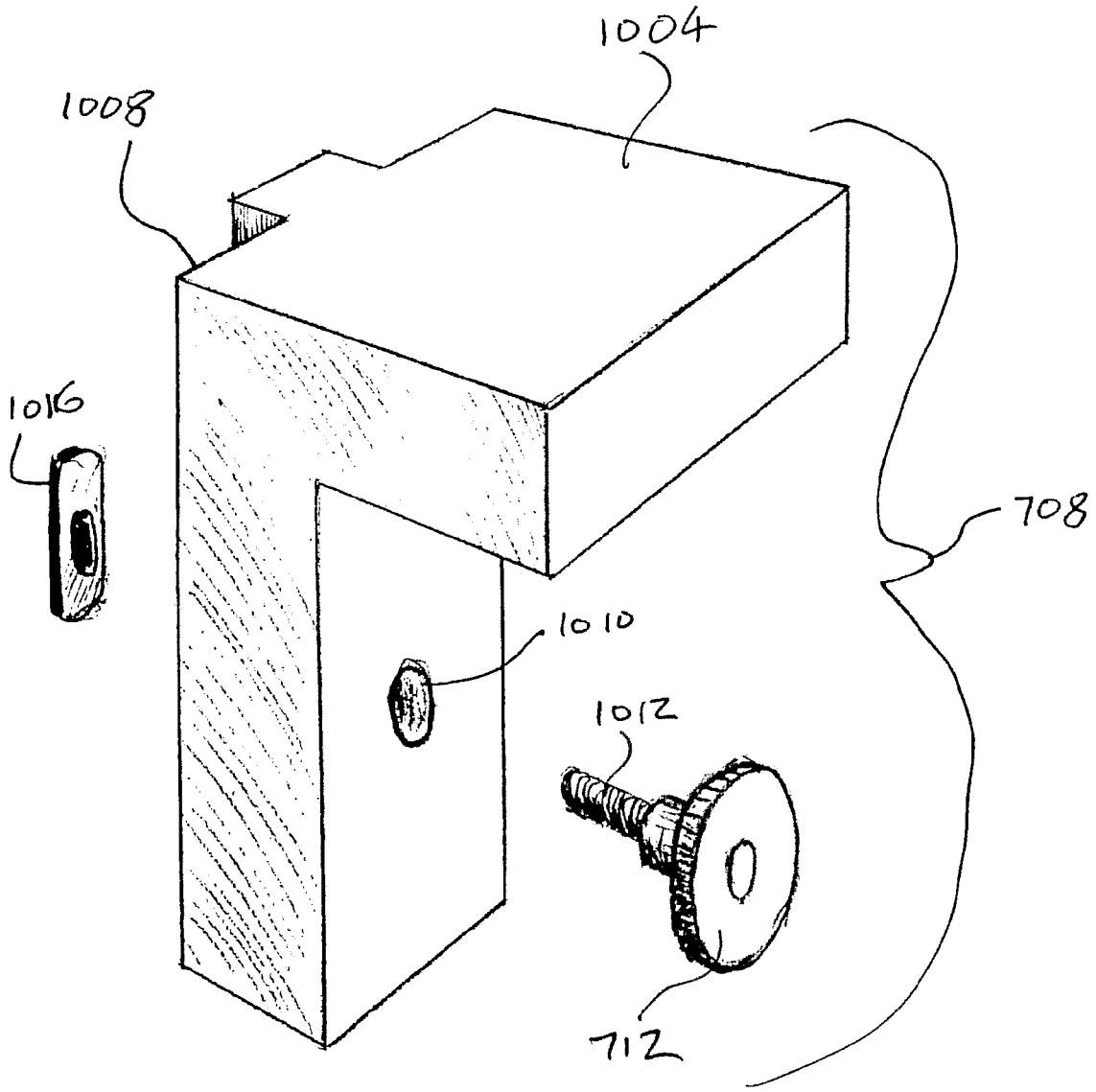
FIG. 10 is a front perspective view of a support block in accordance with embodiments of the present disclosure.

With reference now to FIG. 10, a support block 708 is shown in a top perspective view. In particular, the support block 708 includes a planar top or support surface 1004 that is perpendicular to a back surface 1008. Accordingly, when the support block 708 is received by a vertical track 704, the back surface 1008 is parallel to a longitudinal axis of the vertical track 704, while the support surface 1004 is perpendicular to the longitudinal axis of the vertical track 704. In addition, the fastening knob 712, receiving hole 1010, threaded fastener 1012 connected to the knob 712, and threaded plate 1016 that receives the threaded fastener 1012 to secure the support block 708 at a desired location along a vertical track 708 are shown.

Figure 11:
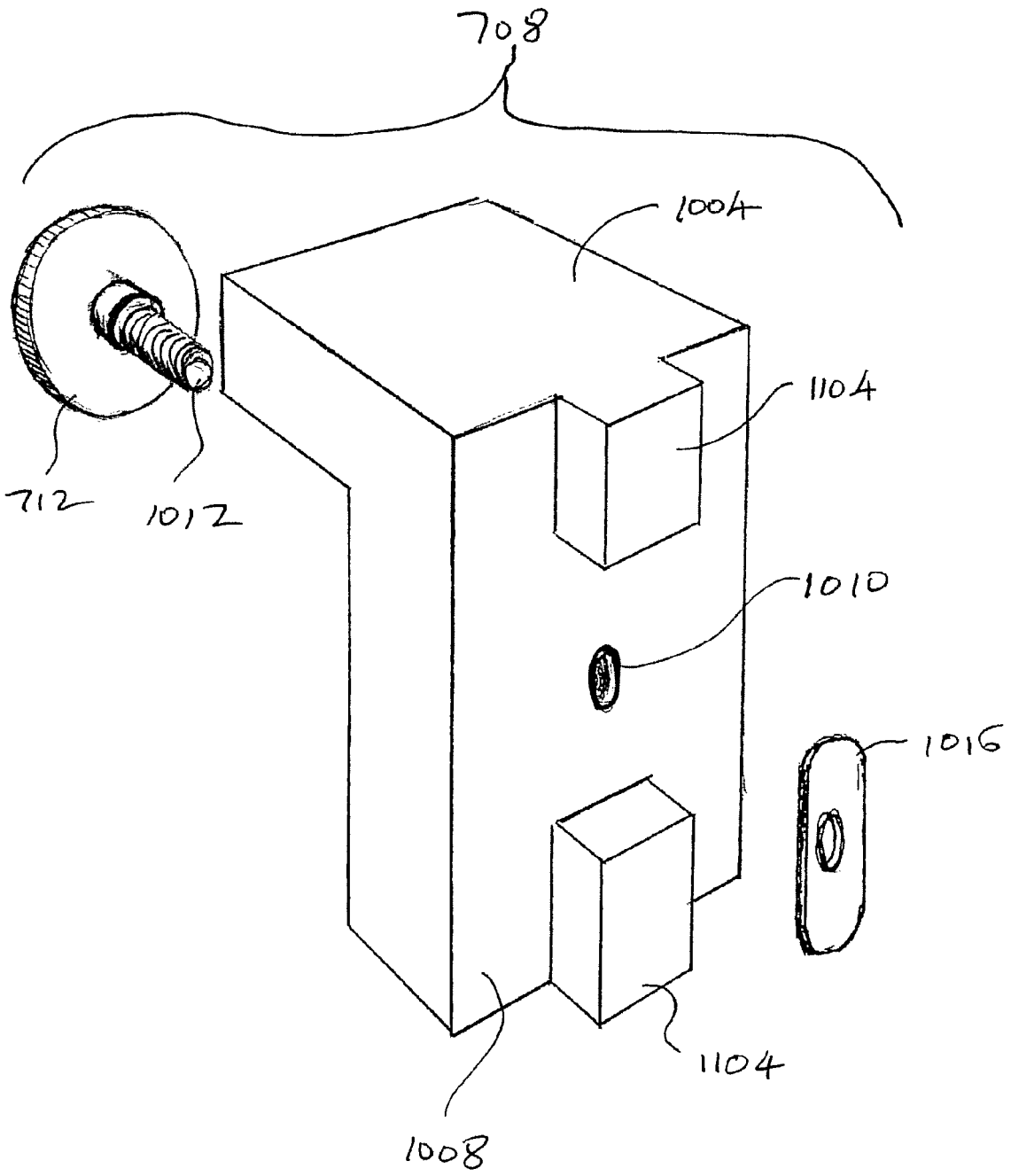
FIG. 11 is a rear perspective view of a support block in accordance with embodiments of the present disclosure.
Figure 12:
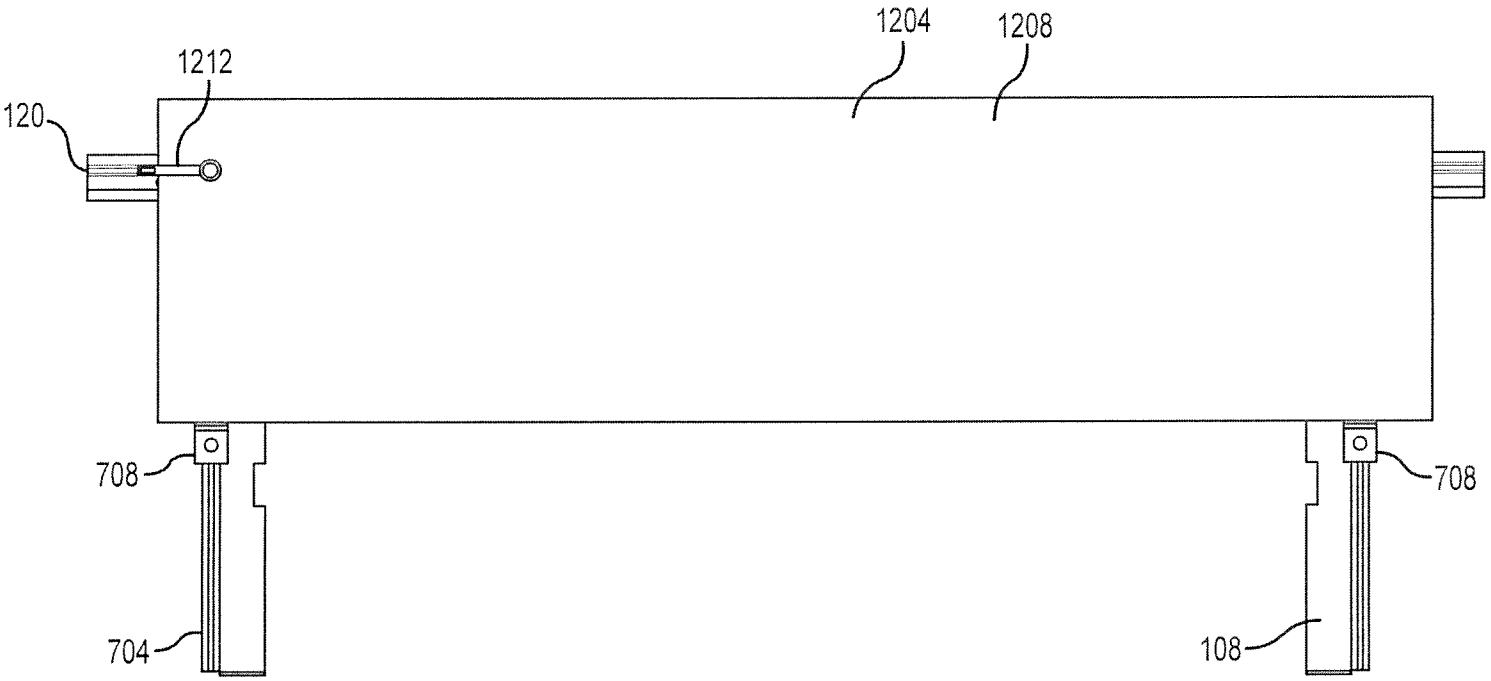
FIG. 12 is a side elevation view of the workbench of FIG. 1, with vertical tracks installed, and with a relatively large work piece held against a side of the workbench.
Figure 13:
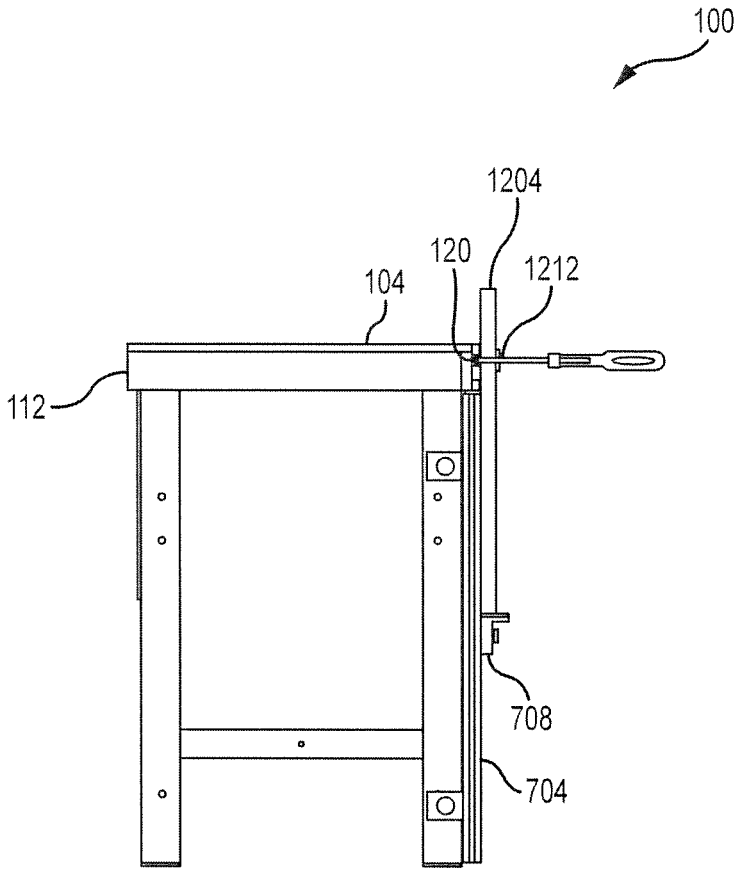
FIG. 13 is an end elevation view of the workbench of FIG. 1, with vertical tracks installed, and with a relatively large work piece held against a side of the workbench.

With reference now to FIG. 11, an exploded, rear perspective view of a support block 708 is shown. In this view, it can be seen that the threaded plate 1016 may have a width that is slightly larger than a gap between the flanges 906 of a channel 904 of the vertical track 704. Accordingly, when installed through an end of the vertical track 704, the support block 708 is captured within the receiving channel 904. As shown, the support block 708 can also include one or more locating members 1104. For example, as shown in FIG. 11, locating members 1104 can be provided on either side of the threaded plate 1104, to maintain an alignment of the support block 708 relative to the vertical track 704. In particular, the support surface 1004 of the support block 708 can be maintained in an orientation that is about (e.g., within ±3°) of being co-planar with the top surface 104 of the work surface 100. In accordance with at least some embodiments of the present disclosure, the locating members 1104 can have a t-shaped profile, to capture the support block 708 within the receiving channel 904.

Figure 14:
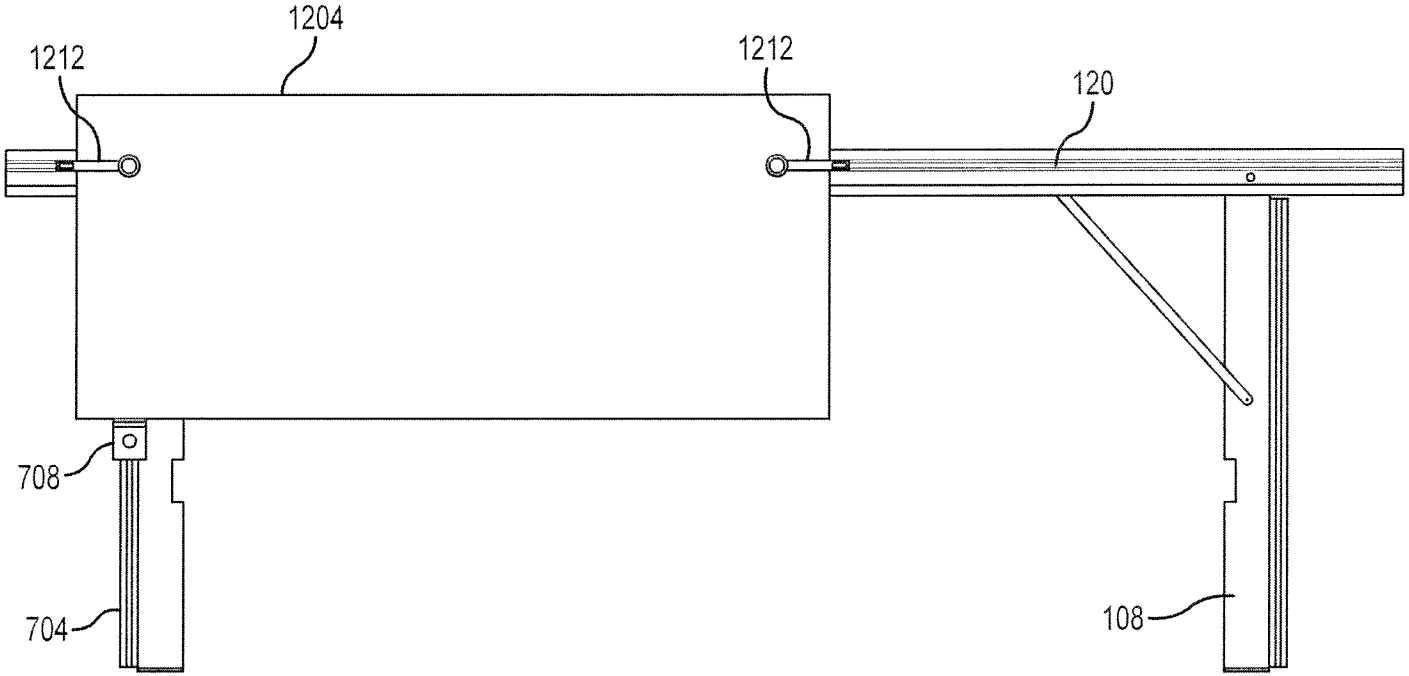
FIG. 14 is a side elevation view of the workbench of FIG. 1, with vertical tracks installed, and with a relatively small work piece held against a side of the workbench.
Figure 15:
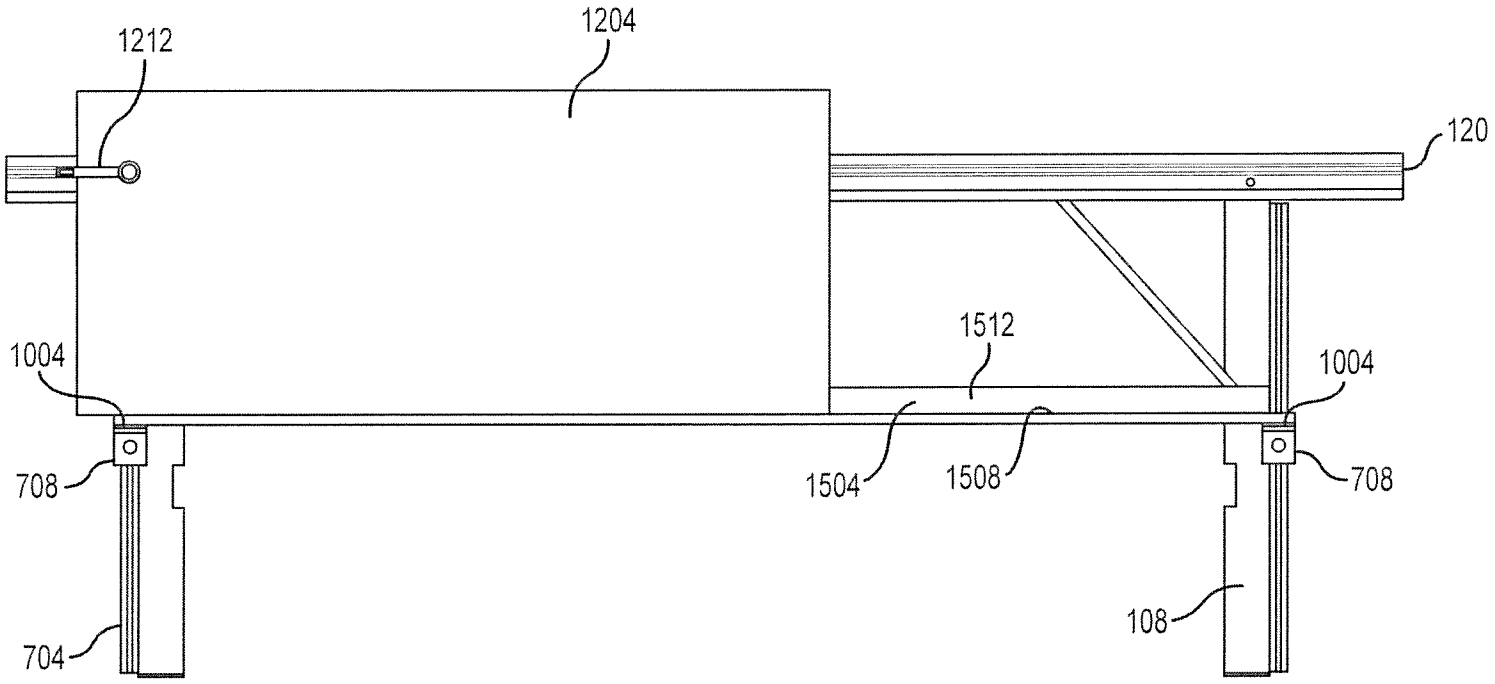
FIG. 15 is a side elevation view of the workbench of FIG. 1, with vertical tracks installed, and with a relatively small work piece held against a side of the workbench and using an alternate support block arrangement.

In addition to supporting workpieces, tools, or other objects on the top surface 104, the table 100 can be configured to hold workpieces during various machining operations. For example, as shown in FIGS. 12-15, components of the table 100 can be configured so as to provide a door/panel support. A door/panel support can be implemented by placing one or more support blocks 708 in vertical tracks 704 attached to one or more legs 108. A planar work piece 1204, such as a door or panel 1208, can then be supported along one edge by the one or more support blocks 708. In addition, the door or panel 1208 can be held against an edge of the top surface 104 by a clamp 1212 placed in the horizontal clamp track 120. Where the work piece 1204 is too short to extend between support blocks 708 on adjacent legs 108, for example as shown in FIG. 14, that work piece 1204 can be placed on one support block 708 at a first end, and can be held by friction against an edge of the top surface 104 by one or more clamps 1212 placed in the horizontal clamp track 120. As yet another alternative, as illustrated in FIG. 15, a pair of support blocks 708 can support or be connected to a support member 1504 that extends between opposed support blocks 708. The support member 1504 can include a first support surface 1508 that is co-planar with the support surfaces 1004 of the support blocks 708. In addition, the support member 1504 can include a back surface 1512 that is co-planar with an outer surface of the vertical tracks 704 and of the horizontal track 120. As shown, the work piece 1204 can further be secured by a clamp 1212 placed in the horizontal clamp track 120. Accordingly, even workpieces 1204 of relatively small size can be held against the side of the support surface 100.

In addition, a work surface 100 can include or be associated with accessory platforms. An example of an accessory platform is a table saw stand. The table saw stand can include locating features that mate to corresponding features provided on a side of a pair of legs of the table or support surface 100, to support a first end of the table saw stand. Legs can be provided to support a second end of the table saw stand. Leg leveler assemblies can be provided for each of the legs, to ensure that a top surface of the table saw stand is parallel to the top surface 104.

The foregoing discussion of the invention has been presented for purposes of illustration and description. Further, the description is not intended to limit the invention to the form disclosed herein. Consequently, variations and modifications commensurate with the above teachings, within the skill or knowledge of the relevant art, are within the scope of the present invention. The embodiments described hereinabove are further intended to explain the best mode presently known of practicing the invention and to enable others skilled in the art to utilize the invention in such or in other embodiments and with various modifications required by the particular application or use of the invention. It is intended that the appended claims be construed to include alternative embodiments to the extent permitted by the prior art.

What is claimed is:

1. A work surface assembly, comprising:

a top surface; a plurality of legs, wherein in a first, extended configuration, a longitudinal axis of each of the legs in the plurality of legs is substantially orthogonal to a plane of the top surface; a horizontal clamp track, wherein the horizontal clamp track has an outer surface that lies within a first plane, and wherein the horizontal clamp track extends along a first outside edge of the top surface; a first vertical track, wherein the first vertical track has an outer surface that lies within the first plane, wherein the first vertical track includes a pair of flanges with a gap therebetween, wherein the pair of flanges form the outer surface of the vertical track that lies within the first plane, and wherein the first vertical track extends along a first leg included in the plurality of legs, and wherein the first vertical track faces outward from a first side of the work surface assembly.

2. The work surface assembly of claim 1, further comprising: a plurality of hinges, wherein each leg in the plurality of legs is connected to the top surface by a hinge included in the plurality of hinges, wherein in a second, folded configuration the longitudinal axis of each of the legs is substantially parallel to the plane of the top surface.

3. The work surface assembly of claim 2, wherein the first vertical track is removed from the first one of the legs when the legs are in the folded configuration.

4. The work surface assembly of claim 1, further comprising: a support block, wherein the support block is received by the first vertical track, and wherein a location of the support block along the first vertical track can be selected by a user.

5. The work surface assembly of claim 4, further comprising; a work piece, wherein at least portions of the work piece lie in the first plane, wherein the first plane that is orthogonal to and that is intersected by the plane of the top surface, and wherein a bottom edge of the work piece is supported by the support block at a first end.

6. The work surface assembly of claim 5, wherein the work piece is held against a side of the top surface by a clamp received by the horizontal clamp track.

7. The work surface assembly of claim 1, further comprising: a second vertical track, wherein the second vertical track extends along a second leg included in the plurality of legs, and wherein the second vertical track faces outward from a first side of the work surface assembly.

8. The work surface assembly of claim 7, wherein the second vertical track has an outer surface that lies within the first plane.

9. The work surface assembly of claim 8, further comprising: a first support block, wherein the first support block is received by the first vertical track, and wherein a location of the first support block along the first vertical track can be selected by a user; a second support block, wherein the second support block is received by the second vertical track, and wherein a location of the second support block along the second vertical track can be selected by a user.

10. The work surface assembly of claim 9, further comprising a support member, wherein the support member extends between the first support block and the second support block.

11. The work surface assembly of claim 10, wherein the support member has a first surface that is co-planar with a support surface of the first support block and with a support surface of the second support block.

12. The work surface assembly of claim 11, wherein the support member includes a back surface that lies within the first plane.

13. The work surface assembly of claim 9, further comprising: a workpiece, wherein the workpiece extends between the first support block and the second support block.

14. A method of supporting a work piece, comprising;

providing a portable work surface, the portable work surface including:

a planar top surface; a plurality of legs, wherein the legs fold flat against a back of the planar top surface when the portable work surface is in a folded configuration, and wherein the legs are substantially orthogonal to the planar top surface when the portable work surface is in a deployed configuration; providing a first vertical track on a first one of the legs, wherein the first vertical track is placed on a first side of the portable work surface, wherein the first vertical track has an outer surface that lies within a first plane, wherein the first vertical track includes a pair of flanges with a gap therebetween, and wherein the pair of flanges form the outer surface of the vertical track that lies within the first plane: placing a first support block in the first vertical track, wherein a location of the first support block along the first vertical track can be selected by a user; supporting a work piece on a support surface of the support block on the first side of the portable work surface, wherein the work piece is substantially planar, wherein the work piece has a surface that lies in the first plane, and lies in a wherein the first plane that-is perpendicular to a plane of the planar top surface.

15. The method of supporting a workpiece of claim 14, further comprising: placing a clamp in a horizontal track adjacent the planar top surface, wherein the horizontal track has an outer surface that lies within the first plane: and clamping the work piece to the first side of the portable work surface using the clamp.

16. The method of supporting a workpiece of claim 14, further comprising: providing a second vertical track on a second one of the legs, wherein the second vertical track is placed on the first side of the portable work surface; placing a second support block in the second vertical track, wherein a location of the second support block along the second vertical track can be selected by the user, wherein the work piece is supported by the first and second support blocks.

17. The method of supporting a workpiece of claim 16, further comprising providing a support member that spans between the first and second support blocks.

18. The method of supporting a workpiece of claim 14, wherein the first support block includes at least a first locating member that extends into at least a portion of the gap between the pair of flanges of the first vertical track, and a support surface that is perpendicular to the first plane.

19. The work surface assembly of claim 4, wherein the support block includes at least a first locating member that extends into at least a portion of the gap between the pair of flanges of the first vertical track, and a support surface that is perpendicular to the first plane.

* * * * *